United States Patent [19]

Schuetz

[11] 4,037,451

[45] July 26, 1977

[54] PIERCING AND REELING MILL CONSTRUCTION WITH REMOVABLE CAP

[75] Inventor: James W. Schuetz, Pittsburgh, Pa.

[73] Assignee: Aetna-Standard Engineering Company, Ellwood City, Pa.

[21] Appl. No.: 682,919

[22] Filed: May 4, 1976

[51] Int. Cl.[2] ..... B21B 31/08

[52] U.S. Cl. ..... 72/238

[58] Field of Search ..... 72/238, 239, 237

[56] References Cited

U.S. PATENT DOCUMENTS

| | | | |
|---|---|---|---|
| 383,056 | 5/1888 | Jones | 72/238 |
| 1,628,175 | 5/1927 | Moller | 72/238 |
| 3,546,912 | 12/1970 | Stinnertz | 72/238 |

*Primary Examiner*—Milton S. Mehr

*Attorney, Agent, or Firm*—Mandeville and Schweitzer

[57] ABSTRACT

The disclosure is directed to structural features of piercing and reeling mills to facilitate and expedite the changing of mill rolls, as is necessary from time to time for accommodation of new work sizes and/or for refurbishing of the rolls. The new mill construction includes a cap member which is removably secured to the upright members of the mill frame structure and forms, in effect, an integral part of the mill structure during normal operation. To effect changing of the mill rolls, provision is made for moving the cap to a laterally offset position, while still supported on the basic mill structure, to permit access to the mill rolls by means of an overhead crane. In the new mill structure, provision for releasing and lateral offset movement of the mill cap is self-contained within the mill structure, so that the plant crane is not required to be utilized in removing the mill cap, as heretofore. In one form, the cap is supported on horizontal flanges or tracks and is moved by self-contained hydraulic actuators. In another form, the mill cap incorporates combined clamps and wheel supports which, in one position, secure the cap to the mill uprights and, in another condition, provide mobile supports for the cap, permitting it to be rolled out of the way to provide overhead access.

11 Claims, 15 Drawing Figures

PIERCING AND REELING MILL CONSTRUCTION WITH REMOVABLE CAP

BACKGROUND AND SUMMARY OF THE INVENTION

In the production of seamless tubing, a cylindrical metal workpiece is advanced over a piercing mandrel, by means of a pair of heavy rolls, arranged at a slight angle to the axis of the workpiece. In accordance with well known principles, the heated workpiece is simultaneously rotated and advanced in a manner to enable it to be driven over a piercing mandrel and formed into a tube. After one or more such piercing operations, the tubing is passed through a plug mill for sizing and then through a reeling mill. The reeling mill serves to rapidly rotate tubular stock about a mandrel, while simultaneously advancing the stock, in a manner calculated to impart greater roundness and uniformity to the cross section.

Because of the need for refurbishing of the rolls, provision is made for bodily removal of roll modules from the mill structure, as may be necessary from time to time. In a typical piercing or reeling mill, the mill rolls are arranged generally on opposite sides of the pass line axis, on the same general horizontal level. Inasmuch as substantial forces must be contained during operation of the mill, the frame structure for supporting the roll modules is extremely heavy and sturdy. To permit occasional removal and replacement of the roll modules, typical construction of piercing and reeling mills includes arrangements for the removable securement of a frame member, customarily referred to as the cap, which extends across the top of the frame and joins the tops of the upright frame members spaced on opposite sides of the pass line. In keeping with the overall construction requirements of the mill frame, the cap members are necessarily of extremely heavy, massive construction.

In the past, in order to effect a change of working rolls in the mill, removal of the mill cap has been accomplished by bringing the plant crane into position over the mill, and bodily lifting and carrying away the cap. Not only is this a relatively hazardous operation, but must be done with great care and results in the utilization of substantial working time of the plant crane. An inevitable result is that the overall task of changing mill rolls consumes an inordinate amount of time and significantly reduces the overall efficiency of utilization of the mill, which is an extremely high capital cost installation, as will be appreciated.

In accordance with the present invention, improved arrangements are made for the mounting and support of the mill caps for piercing and reeling mills, enabling the mill caps to be removed quickly and without the intervention of the plant crane, thus significantly expediting the roll changing operation. More particularly, the mill construction is such that the cap structure is self-supported on extensions of the mill frame, and the mill structure is provided with self-contained means for effecting lateral movement of the mill cap from its normal working position, in order to provide overhead crane access to the mill roll modules.

In one advantageous form of the invention, the mill cap is slideably supported and guided on the mill frame uprights, and lateral extensions thereof, providing for accurately guided sliding movement of the cap into a laterally offset position to provide access to the mill rolls. In conjunction therewith, the slideable guide ways, cooperatively positioning the cap and the mill uprights, are slightly tapered in a direction such that, when the cap is moved in a mill-opening direction, free sliding clearance is provided whereas, when the cap is returned in the mill-closing direction, the guide clearance is closed and the cap is forced into a precise alignment. Heavy-duty, quick releasing clamp means are provided for securing the cap in its mill-closing position to provide an effectively unitary mill frame suitable for supporting the mill rolls against the heavy forces of the rolling operation.

In another advantageous form of the invention, double acting fluid actuator means are provided which, in one condition, serve to rigidly clamp the cap in its mill-closing position. In the other condition of the double acting fluid cylinders, the cap is raised up off of the vertical supports and is supported in a mobile fashion on track-supported wheels, enabling the cap to be easily moved off to the side to provide overhead access to the mill rolls.

In either of its forms, the mill structure of the invention greatly expedites the process of mill roll exchange and thus substantially improves the capital use efficiency of the mills.

For a more complete understanding of the above and other features and advantages of the invention, reference should be made to the following detailed description of preferred embodiments and to the accompanying drawings.

DESCRIPTION OF PREFERRED EMBODIMENTS

Figure 1:
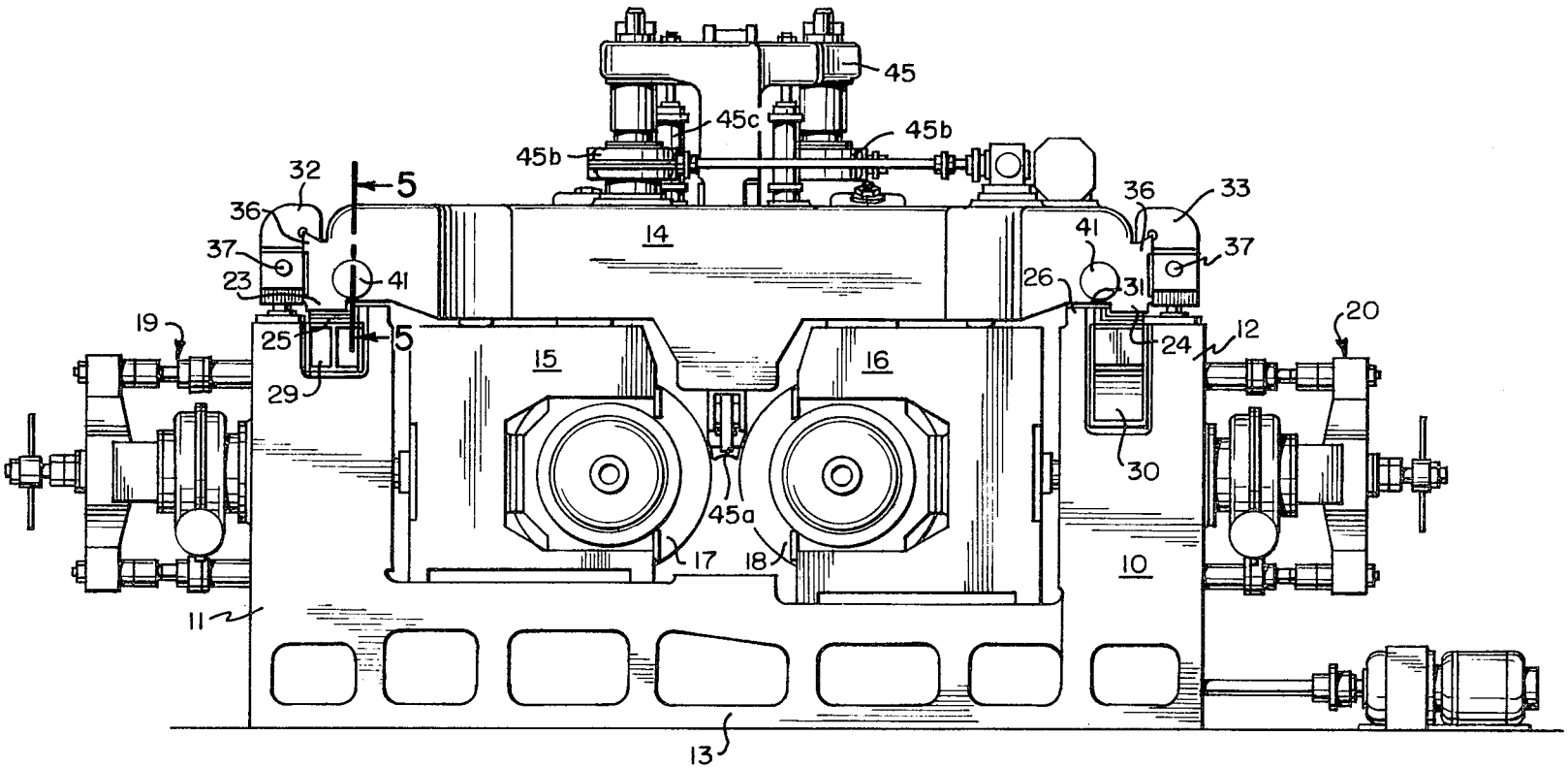
FIG. 1 is a front elevational view of a piercing mill constructed in accordance with the principles of the invention, so as to have a self-supported, slideably removable mill cap.

Referring now to the drawings, and initially to FIGS. 1–8 thereof, the reference numeral 10 designates generally the base frame section of a piercing mill. This base frame section is of generally U-shaped configuration, including frame uprights 11, 12 and a bottom section 13, preferably constituting a single casting or weldment. Extending across the top of the frame uprights 11, 12 is a cap, generally designated by the numeral 14, which joins the upper ends of the frame uprights and serves to close the frame in a generally rectangular configuration.

In accordance with known principles, the mill includes a pair of opposed roll modules 15, 16 supporting mill rolls 17, 18. By adjustment mechanisms 19, 20 at each side, the roll modules may be moved toward or away from the central axis or pass line of the mill, and the individual rolls 17, 18 may be adjustably disposed with their axis of rotation at a predetermined angle relative to the pass line. Drive couplings 21, 22 are connected to the mill rolls 17, 18 and are arranged to be joined with mill drive shafts (not shown) in a conventional manner.

In accordance with conventional practice, in order to effect a change of the mill rolls, the cap 14 is detached from the frame uprights 11, 12 and physically lifted off by the plant crane, carried to a suitable location and set down. The crane then returns to pick up the roll modules 15, 16, moving them and replacing them with new modules. The plant crane then returns to pick up the cap and replace it on the mill frame. The handling of the mill cap not only requires two additional excursions of the plant crane, but involves significant time in the handling of the cap, because of its substantial mass and bulk and the relative precision and care with which it must be handled during removal and replacement.

In accordance with the present invention, the cap 14 is mounted for horizontally slideable movement on the base section 10 of the mill frame. To this end, the mill cap 14 is provided with short downwardly extending flanges 23, 24, which extend along the full length of the cap at each side. These flanges are supported on the upper ends of the frame uprights and have a cooperative sliding relationship with similar, upwardly projecting flanges 25, 26 formed on the insides of the mill frame uprights (see FIG. 7, for example). On the cap flanges 23, 24, there are provided L-shaped bearing strips 27, and similar L-shaped bearing strips 28 are mounted at the flanged upper ends of the mill uprights 11, 12. The pairs of bearing strips 27, 28 are arranged for close-fitting, sliding cooperation. The frame-supported bearing strip 28 serves in effect as a guide track for the mill cap 14 and, in accordance with the invention, this track is extended beyond the mill frame proper, by means of track extensions 29, 30 at each side. The track extensions of an appropriate structural strength to support the weight of the cap 14, and are of a sufficient length to enable the cap to be moved out onto the extensions sufficiently to provide clear overhead access to the roll modules 15, 16 (see FIG. 4). The extensions 29, 30 form in effect a continuation of the upper supporting surface 31 of the mill uprights 11, 12, such that the L-shaped bearing strips 28 may extend continuously, if desired, and in any event form an effectively continuous bearing surface over the full length from one side of the frame uprights to the end extremity of the extensions 29, 30, on the opposite side.

For securing the mill cap in its operative or mill-closed position, elongated clamping bars 32, 33 are provided at each side of the mill. As reflected particularly in FIG. 7, these clamping bars are provided with elongated, dovetailed clamping surfaces 34 which cooperate with similar dovetailed shoulders 35 formed on clamping rails 36 extending along the sides of the mill cap. The clamping bars 32, 33 are connected by pin bearings 37 to heavy-duty hydraulic actuators 38 anchored by pins 39 in the frame uprights. The anchor pins 39 project horizontally and transversely to the pass line, enabling some degree of forward, rearward pivoting movement of the cylinders 38. Accurate adjustment of the cylinder positions, and thereby accurate forward-rearward adjustment of the positioning of the clamping bars 32, 33, is effected by adjusting bolts 40 (see FIG. 6). When the mill cap 14 is in the mill-closed position, as reflected in FIG. 3, the hydraulic actuators 38 are actuated to retract, drawing downward on the clamping bars 32, 33 and securing the cap rigidly on the mill uprights 11, 12 to form an effectively unitary, closed mill housing. By extending the actuators, clamping force is released to accommodate the desired opening movement of the cap.

Figure 5:
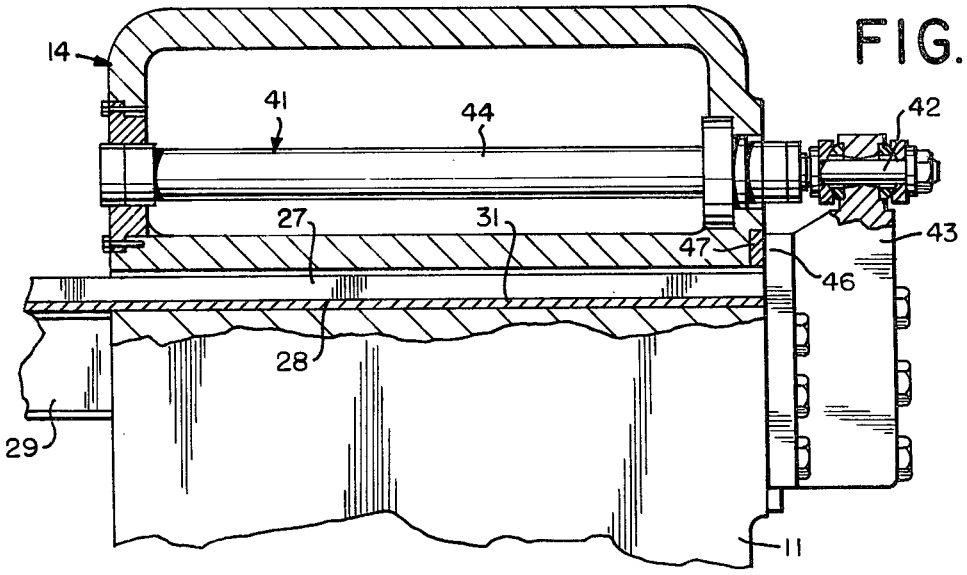
FIG. 5 is a fragmentary cross sectional view as taken generally on line 5—5 of FIG. 1.
Figure 6:
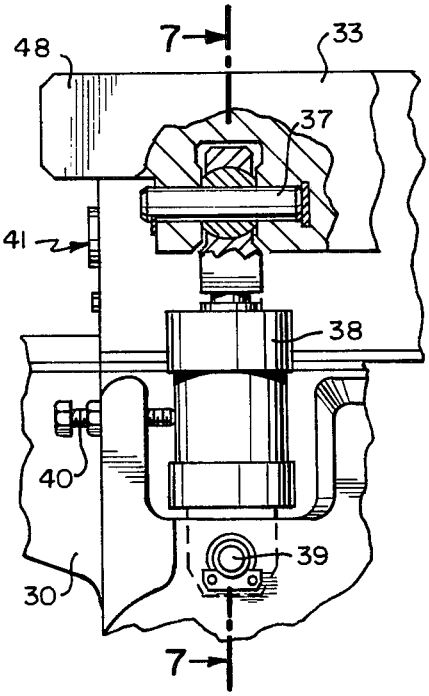
FIG. 6 is a fragmentary view, with parts broken away, illustrating structural details of clamping means utilized in securing the mill cap in the structure of FIG. 1.
Figure 7:
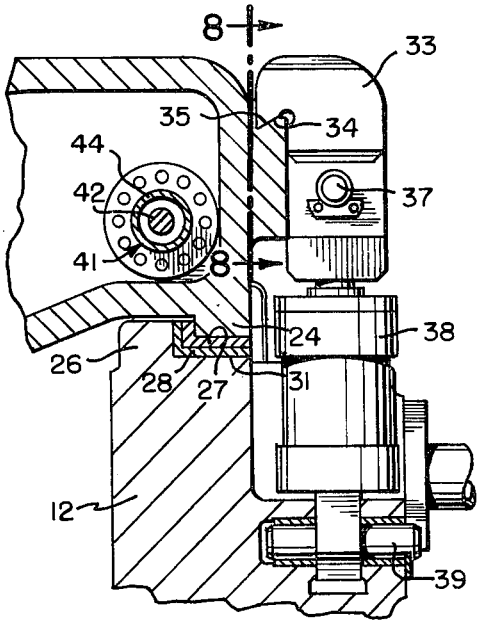
FIGS. 7 and 8 are cross sectional views as taken generally on lines 7—7, 8—8 respectively of FIGS. 6 and 7 respectively.
Figure 8:
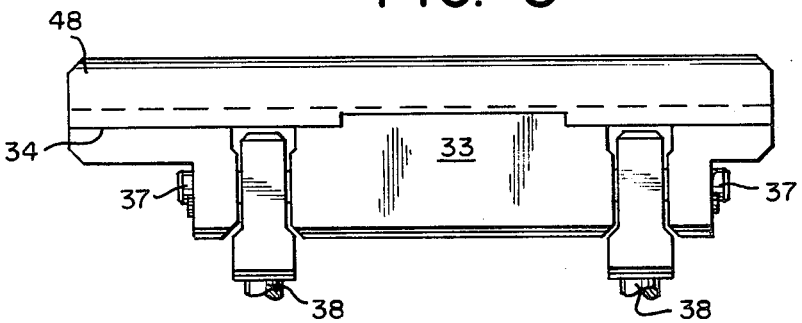
Figure 9:
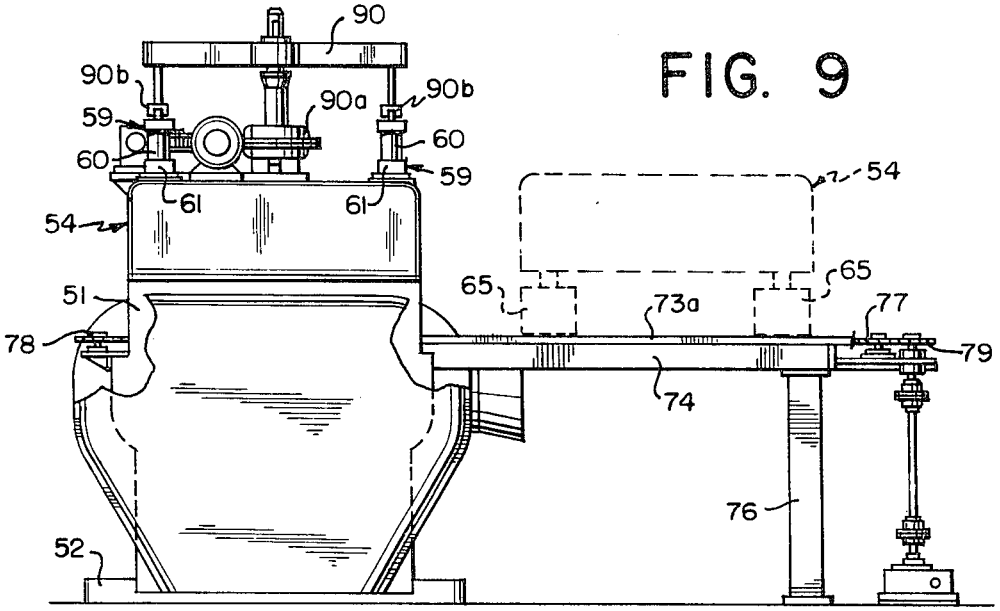
FIG. 9 is a side elevational view of a reeling mill constructed in accordance with the invention to provide for self-contained means for removal and support of the mill cap.
Figure 10:
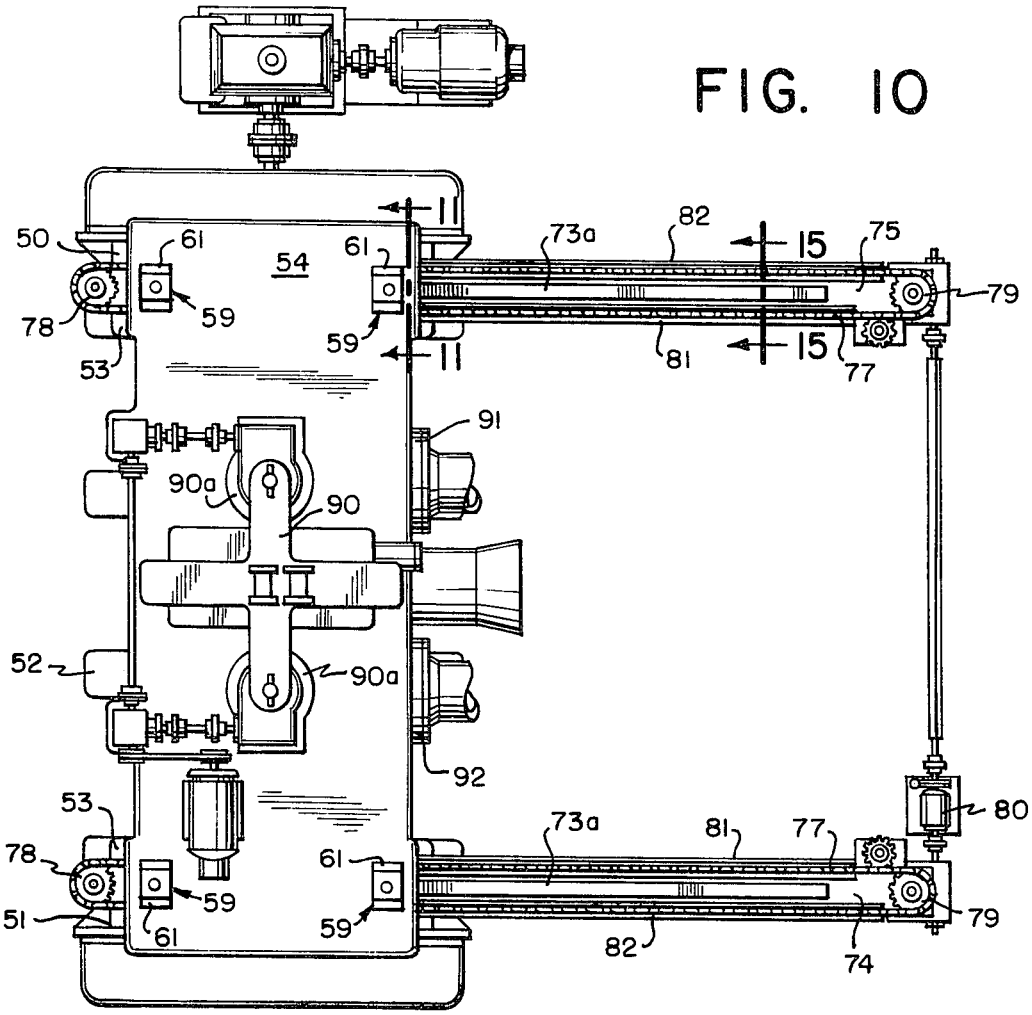
FIG. 10 is a top plan view of the mill of FIG. 9.
Figure 13:
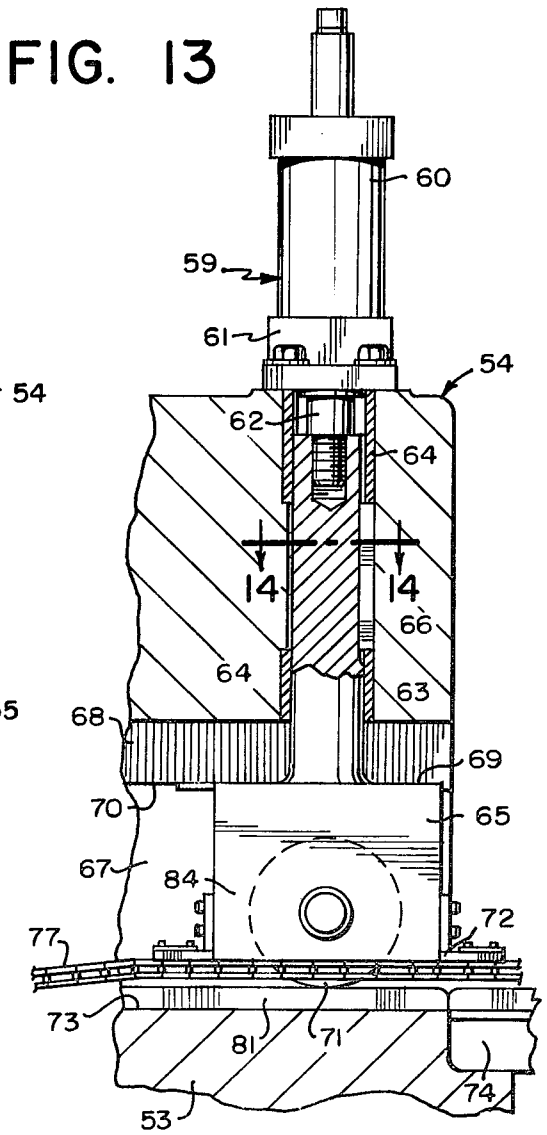
FIG. 13 is a cross sectional view as taken generally on line 13—13 of FIG. 11.
Figure 12:
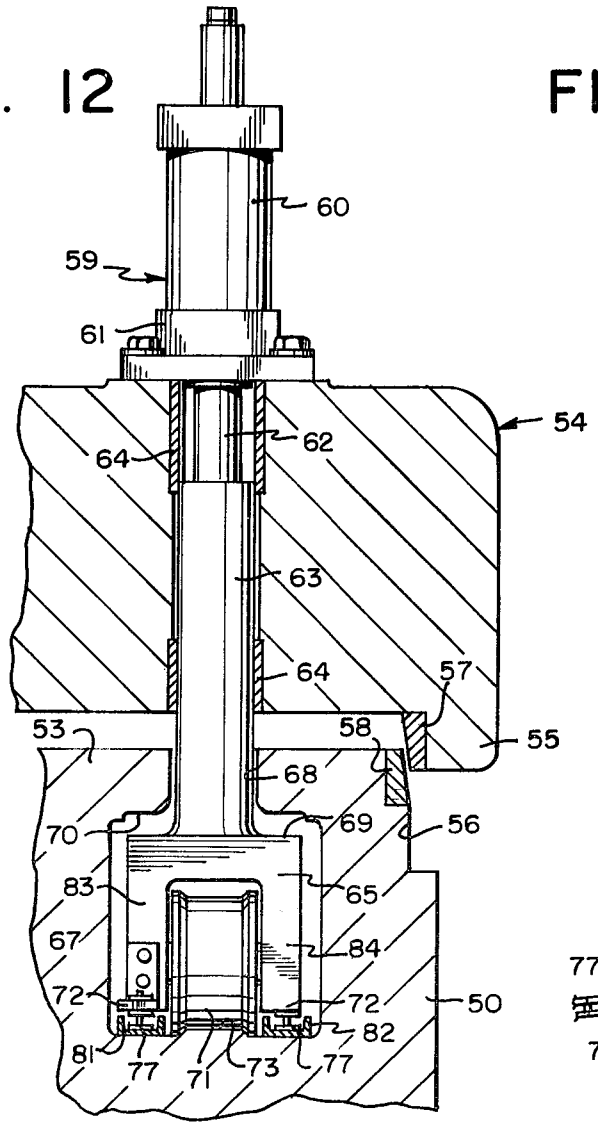
FIGS. 11 and 12 are enlarged, fragmentary cross sectional views as taken generally on line 11—11 of FIG. 10, illustrating the parts in different operating positions.
Figure 11:
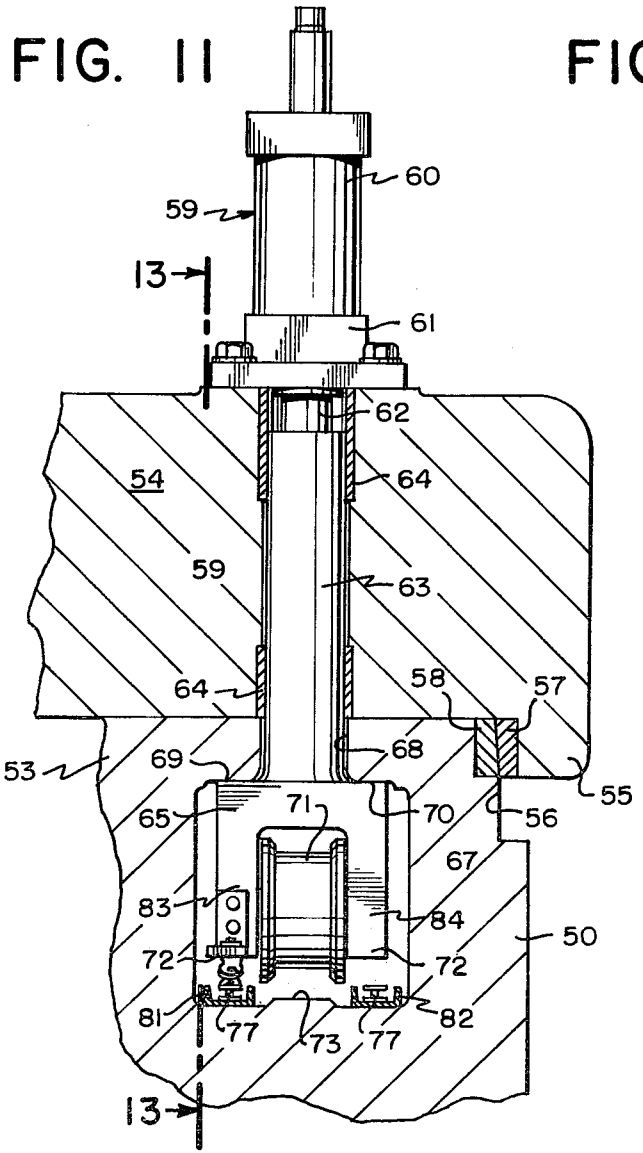

As reflected particularly in FIG. 5, the mill cap 14 houses a pair of elongated, cap displacement fluid actuators 41, the operating rods 42 of which are anchored by brackets 43 secured to the mill frame uprights 11, 12. In the illustrated arrangement, the cylinder members 44 of the actuators 41 are mounted internally of the cap 14, extending longitudinally from one end to the other thereof and generally aligned over the tops of the uprights 11, 12.

Opening movement of the mill cap 14 is effected by first releasing the clamping bars 32, 33 by slightly extending the fluid actuators 38. This lifts the clamping bars off of the dovetailed clamping shoulders 35. When clamping pressure has been released, hydraulic fluid is admitted to the piston ends of the cap displacement actuators 41, causing the cylinder members 44 thereof to be displaced relative to the rod members, and thereby moving the mill cap out on to the extensions 29, 30, as reflected in FIG. 4.

Figure 2:
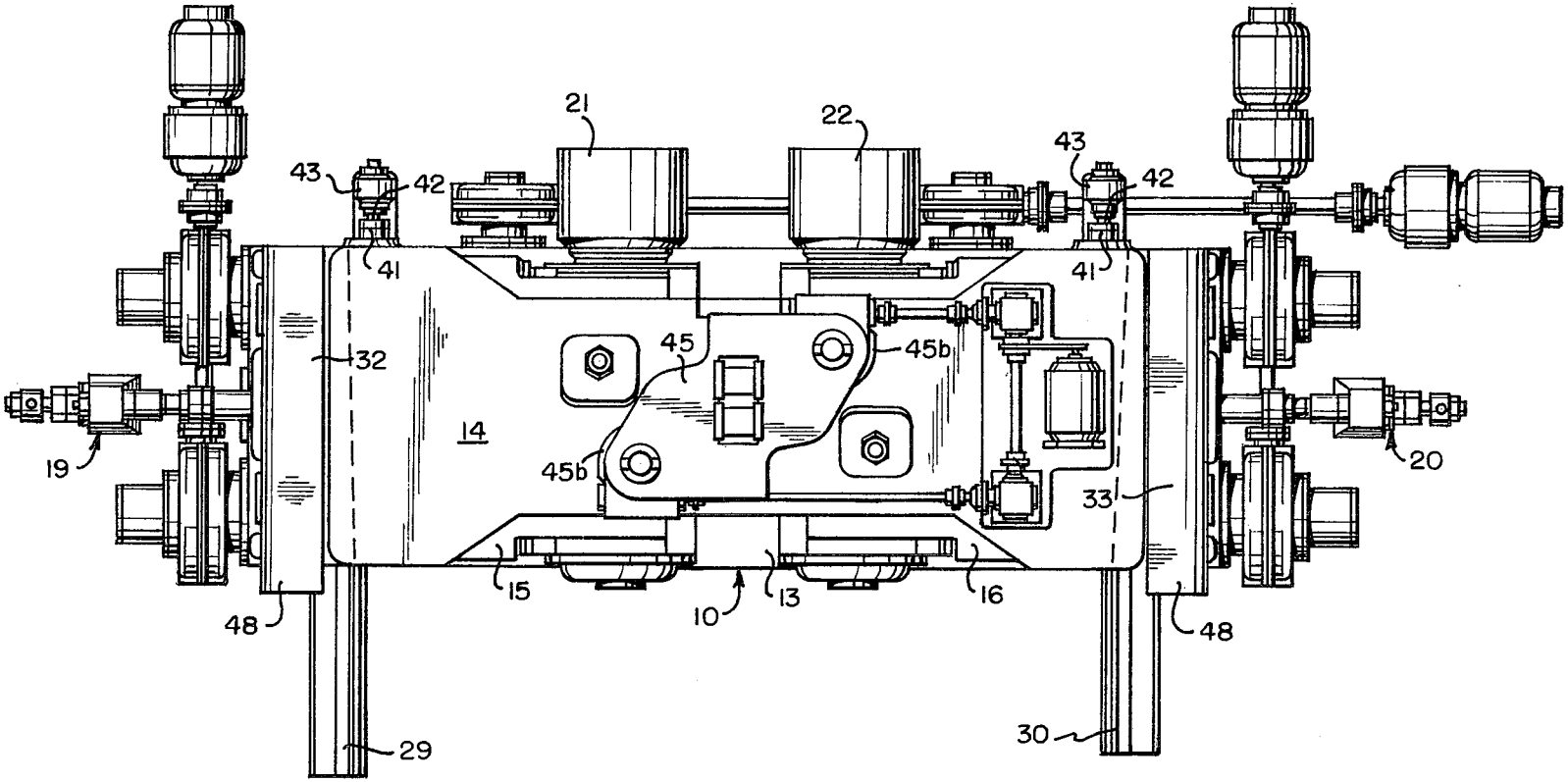
FIG. 2 is a top plan view of the piercing mill of FIG. 1.

To particular advantage, the cooperating flanges 24, 26 on the mill cap and uprights are formed with a slight amount of taper in a horizontal plane as shown in exaggerated form by broken lines in FIG. 2. This can be relatively imperceptible to the eye, amounting to perhaps a few millimeters over the full width (parallel to the pass line) of the mill uprights 11, 12. The arrangement is such that, as the cap is initially displaced in the mill-opening direction, a slight clearance opens up between the confronting vertical surfaces of the L-shaped bearing strips 27, 28, facilitating the continued opening movement of the heavy mill cap. As is apparent in FIG. 4, the length of the cap displacement actuators 41 is such as to enable the cap to be displaced substantially the full width of the uprights, sufficient in any ase to provide for vertical access of the plant overhead crane to the roll modules 15, 16.

In conjunction with the cap opening movement, it is generally necessary or desirable to first raise the upper mill shoe support 45, lifting the upper mill shoe **45*a* sufficiently to easily clear the rolls 17, 18. This can be accomplished by conventional screw down mechanisms 45*b* and fluid actuators 45*c*.**

Return movement of the cap, after exchange of the roll modules, is effected by admitting pressure fluid into the rod ends of the actuators 41, to move the mill cap back on to the uprights 11, 12. In this instance, by virtue of the gradual horizontal convergence of the bearing strips 27, 28, the cap 14 is guided precisely into accurate alignment with the fixed members of the frame, as the cap reaches the limit of its return movement. Suitable stop means is provided to position the cap member properly in its mill-closing condition. In the illustrated arrangement, this may be in the form of upward extensions 46 of the rod anchoring brackets 43, arranged for abutting contact with stop elements 47 on the mill cap. As the mill cap approaches engagement of the stop abutments 46, 47, the bearing strips 27, 28 reach full convergence, so that the mill cap more or less locks itself accurately into mill-closing position. At that stage, the clamping actuators 38 are charged at the rod ends to draw the clamping bars 32, 33 tightly downward to secure the cap.

Figure 3:
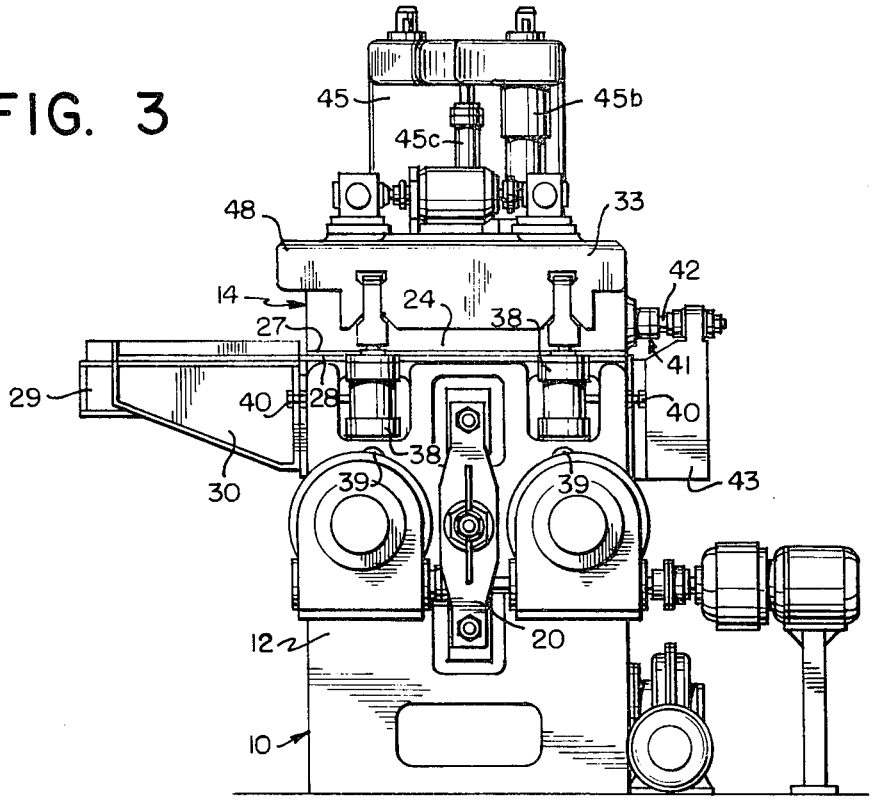
FIG. 3 is a side elevational view of the piercing mill of FIG. 1, illustrated with the cap in the mill-closed position.
Figure 4:
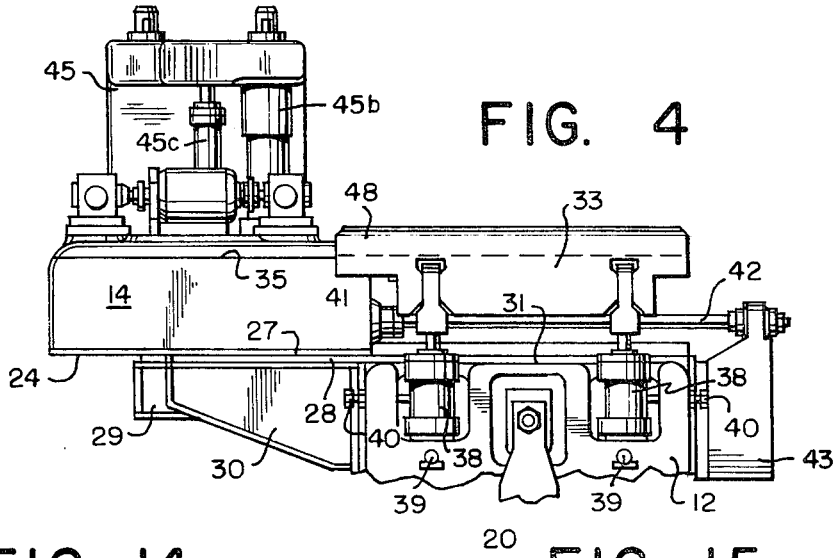
FIG. 4 is a fragmentary side elevational view, similar to FIG. 3, but with the mill cap in the mill-open position.
Figure 14:
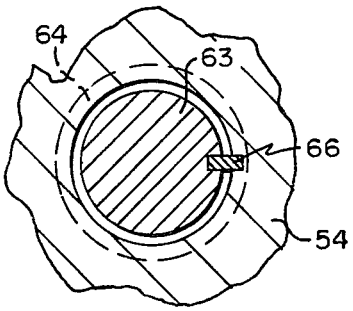
FIG. 14 is a fragmentary cross sectional view as taken generally on line 14—14 of FIG. 13.
Figure 15:
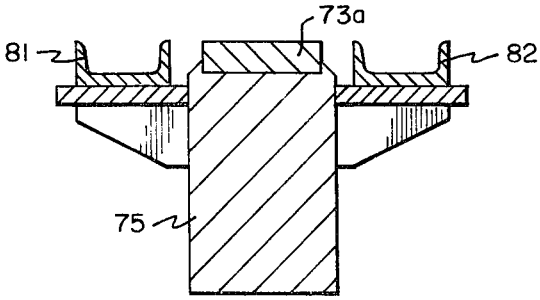
FIG. 15 is a cross sectional view as taken generally on line 15—15 of FIG. 10.

As reflected in FIGS. 3 and 4, it may be advantageous to provide an extension 48 at one end of the clamping bars 32, 33, so that a loose alignment is maintained between the clamping bars and the dovetailed shoulder 35 of the mill cap, when the cap is in its mill-opening position, shown in FIG. 4. This assures proper alignment of the cap and clamping bars when the cap is later returned toward the closing position.

Referring now to FIGS. 9–15, there is illustrated an advantageous utilization of the invention in conjunction with a reeling mill. In many respects, the construction of the reeling mill bears a general similarity to that of the piercing mill, although the force requirements for the reeling mill tend to be somewhat less than for a piercing mill. Thus, in the representative illustration of FIGS. 9 and 10, the mill includes side frames or uprights 50, 51 joined to a base 52 and forming a generally U-shaped, open top frame, which may be a unitary casting or weldment. The upper ends 53 of the upright frames 50, 51 are connected by a mill cap, which is generally designated by the numeral 54. The cap 54 has downwardly projecting flanges 55 at each side, which extend along the full length (parallel to the pass line) of the cap and cooperate with upper sections 56 of the mill uprights 50, 51. Desirably, bearing strips 57, 58 (FIG. 11) are carried by the flange 55 and frame surface 56, and these bearing strips are in tightly abutted relationship when the mill cap is in the mill-closed position. Desirably, the confronting surfaces of the bearing strips 57, 58 are angled upward and inward slightly so that there is a convergence of the confronting surfaces as the cap is lowered onto the mill frame uprights 50, 51. When the cap is fully seated, the respective bearing strips 57, 58 are fully converged and tightly engaged, serving to effect precise side-to-side location of the mill cap.

In accordance with the invention, the mill cap carries a plurality (advantageously two at each side) of combined clamping and lifting mechanisms 59. These include fluid actuators 60 having cylinder portions 61 secured to the mill cap and rod portions 62 extending downward into the cap and there joined with lifting and clamping rod members 63. The lifting-clamping rods are guided for vertical movement by bearings 64 in the mill cap and carry at their lower ends brackets 65 of inverted U-shaped configuration. The rods 63 are secured against rotation by keys 66 (FIG. 13, 14) while limited vertical movement of the rods 63 is accommodated. The several U-shaped brackets 65 are received with ample vertical and transverse clearance in longitudinally extending tunnel-like windows 67 in each of the mill frame uprights 50, 51. Likewise, the mill frames are provided with longitudinally elongated slots 68 for receiving the lower portions of the rods 63, accommodating longitudinal movement of the rods 63 and brackets 65 relative to the mill frame uprights 50, 51.

In accordance with one aspect of the invention, the upper surfaces 69 of the brackets 65 form clamping shoulders engageable with confronting clamping surfaces 70 formed at the top of the window tunnels 67. Accordingly, when the fluid actuators 60 are charged with fluid and caused to retract, the brackets 65 are drawn upwards, bringing the confronting surfaces 69, 70 into contact and drawing the mill cap 54 tightly downward onto the frame uprights 50, 51. In addition to the foregoing, the brackets 65 carry flanged wheels 71, the lower portions of which project downward below the lower extremities 72 of the brackets 65 and are engageable with longitudinally extending tracks 73 formed in the mill frame uprights 50, 51 and also track extensions **73*a* provided on extension beams 74, 75, which are supported at their outboard ends by legs 76**.

In order to remove the mill cap 54 from its normal, mill-closing position, the several fluid actuators 60 are extended. This causes the brackets 65 to move downward within the windows 67, which have a somewhat greater vertical dimension than the combined vertical dimension of the brackets 65 and wheels 71. The clamping action of the surfaces 69, 70 is thus released, and the wheels 71 are brought to bear on the guide tracks 73. Continued introduction of pressure fluid into the piston ends of the actuator 60, after initial engagement of the wheels 71 with the tracks 73, causes the cap 54 to be lifted bodily upward from the ends of the frame uprights. Simultaneously, the tapered bearing strips 67, 58 form a slight side clearance, so that the mill cap 54 is entirely free of the uprights. The cap may then be freely rolled, on the wheels 71, out on to the track extensions **73*a*, providing clear overhead access to the mill roll modules 91, 92**, so that the same may be removed by the plant overhead crane.

In the illustrated form of the invention, lateral movement of the unclamped and lifted mill cap is effected by means of endless chains 77, engaged by end sprockets 78, 79 and driven in unison by a common drive motor 80. The longitudinally extending portions of the chain are guided in channels 81, 82, located on opposite sides of the tracks and track extensions **73, 73*a* and located generally directly underneath the spaced legs 83, 84 of the U-shaped brackets 65. One of the chain reaches on each side is secured to one or both of the brackets 65 on that side, such that, when the chain is driven, the brackets 65 will move along with it, to advance the mill cap 54 in the desired direction. The chains 77 have sufficient flexibility to accommodate the limited vertical movement of the brackets 65 when moving between clamping and lifting positions, as is reflected in FIGS. 11–13**.

As in the case of the piercing mill, the chair structure 90, supporting a mill shoe and adapter (not shown) between the roll modules 91, 92, will be raised prior to horizontal movement of the cap in the opening direction, in order to freely clear the roll modules. The means provided for this purpose can be generally conventional, such as screw downs **90*a* and fluid actuators 90*b***.

In either of its basic forms, the arrangement of the invention provides for significant efficiencies and economies in the utilization of piercing and reeling mills. By providing for the self-contained lateral removal of the mill cap, providing immediate overhead access to the roll modules, the turn around time involved in the changing of roll modules may be very significantly reduced. As compared to prior practice, the turn around may be effected with the elimination of two trips of the overhead crane involved in the conventional removal and replacement of the mill cap. Bearing in mind the rather delicate and critical placement of the extremely heavy and bulky mill cap, the operations involved in removal and replacement of the cap by the plant overhead crane, in accordance with conventional practice, tend to be substantially time consuming. With the apparatus of the invention, on the other hand, the mill cap members are released and laterally displaced, while still supported on the basic mill structure, permitting immediate access to the roll modules by the overhead crane. The extra trips of the crane are eliminated altogether, and there are no problems in effecting precise realignment of the cap when the mill is again closed after replacement of the roll modules.

Although in the illustrated forms of the invention, one form of the invention is shown for use in conjunction with a piercing mill, and another in conjunction with a reeling mill, it is not intended that the particular embodiments are thus limited in their application. The principal feature in either case is the provision of quickly releasable clamping means, movable support means for the cap, and lateral extension of the cap support on either the upstream or downstream side of the mill frame, enabling the cap to be moved sufficiently far to provide clear overhead access into the mill roll modules.

Where the size and weight of the mill components permit, the arrangement shown in FIGS. 9–15 may be utilized to advantage, by deriving both lifting and clamping functions from a single set of fluid actuators.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A top opening mill for rolling tubular workpieces, which comprises a. a lower mill frame structure comprising a base and spaced sets of frame uprights on opposite sides of the mill pass line, b. a mill cap extending over the pass line and adapted to connect the top of said sets of frame uprights to form a closed mill frame structure for the containment of removable mill roll modules, c. a retractable mill shoe support carried by said cap, d. means for releasably clamping said mill cap to said mill frame uprights, e. generally horizontal guiding and support means for guiding and supporting said mill cap for longitudinal movement relative to the mill uprights in the direction of said pass line, and f. means for controllably moving the unclamped mill cap on said support means, whereby to provide overhead access to the mill rolls.

2. The top opening mill of claim 1, further characterized by a. said generally horizontal support means including linear guide track means formed in the upper portions of said frame uprights, and b. means forming structural extensions of said guide means, whereby said mill cap may be moved to a position substantially longitudinally offset from said mill uprights while remaining supported on said structural extensions.

3. The top opening mill of claim 1, further characterized by a. cooperating tapered slide bearing means on said mill cap and said mill uprights forming part of said linear guide track means, whereby clearance is provided during mill-opening movement of said cap.

4. A top opening mill for rolling tubular workpieces, which comprises a. a lower mill frame structure comprising a base and spaced frame uprights, b. a mill cap adapted to connect the top of said frame uprights and form a closed mill frame structure for the containment of removable mill roll modules, c. means for releasably clamping said mill cap to said mill frame uprights, d. generally horizontal support means for guiding and supporting said mill cap for movement relative to the mill uprights, e. means for controllably moving the unclamped mill cap on said support means, whereby to provide overhead access to the mill rolls, f. said cap being slideably supported on the upper ends of said mill uprights, g. means forming structural extensions of said upper ends for accommodating sliding movement of the mill cap sufficient to provide clear overhead crane access to the mill rolls, and h. fluid actuator means mounted on said mill cap and connected to said mill frame uprights for slideably moving the unclamped mill cap.

5. The top opening mill of claim 4, further characterized by a. the means for guiding and supporting said mill cap comprising cooperating tapered guide bearing means arranged for converging cooperation during closing movements of said mill cap.

6. The top opening mill of claim 4, further characterized by a. said fluid actuators include cylinder members mounted in said mill cap and rod members anchored to said mill frame uprights.

7. The top opening mill of claim 4, further characterized by a. said releasable clamping means comprising elongated clamping bars carried by said mill uprights at each side of the mill cap and slideably engageable with said cap during opening movement thereof.

8. A top opening mill for rolling tubular workpieces, which comprises a. a lower mill frame structure comprising a base and spaced frame uprights, b. a mill cap adapted to connect the top of said frame uprights and form a closed mill frame structure for the containment of removable mill roll modules, c. means for releasably clamping said mill cap to said mill frame uprights, d. generally horizontal support means for guiding and supporting said mill cap for movement relative to the mill uprights, e. means for controllably moving the unclamped mill cap on said support means, whereby to provide overhead access to the mill rolls, f. said clamping means comprising vertically movable actuator rods mounted on said mill cap and extending downward into said mill frame uprights, g. said uprights having longitudinally elongated slots for the reception of said rods and longitudinally elongated tunnel-like windows below and communicating with said slots, h. clamping brackets connected to said actuator rods and movably received in said windows, and i. said clamping brackets being movable upward against the upper walls of said windows to effect clamping of said mill cap.

9. The top opening mill of claim 8, further characterized by a. the lower portions of said windows forming longitudinally extending guide tracks, and b. wheels being mounted on said clamping brackets and operable upon downward movement of said actuator rods to lift said mill cap and support it for wheeled movement on said guide tracks.

10. The top opening mill of claim 9, further characterized by a. said mill cap and said mill frame uprights having cooperating, vertically converging bearing strips arranged for converging engagement during lowering and clamping of said mill cap.

11. The top opening mill of claim 9, further characterized by a. endless flexible driving elements secured to said brackets and disposed along said guide tracks, and b. means for moving said driving elements controllably in either direction to move the unclamped mill cap in mill-opening and mill-closing directions.

* * * * *